United States Patent [19]

Segerström

[11] 4,018,549

[45] Apr. 19, 1977

[54] SCREW PUMP

[75] Inventor: Lars Segerström, Skarholmen, Sweden

[73] Assignee: Aktiebolaget Imo-Industri, Stockholm, Sweden

[22] Filed: Mar. 29, 1976

[21] Appl. No.: 671,486

[30] Foreign Application Priority Data

Apr. 2, 1975 Sweden ..... 75037879

[52] U.S. Cl. ..... 418/197; 418/201

[51] Int. Cl.[2] ..... F04C 17/12

[58] Field of Search ..... 418/196, 197, 201, 202, 418/203, 270

[56] References Cited

UNITED STATES PATENTS

| | | | |
|---|---|---|---|
| 3,086,474 | 4/1963 | Sennet | 418/197 |
| 3,181,472 | 5/1965 | Sennet | 418/196 X |

*Primary Examiner*—Carlton R. Croyle
*Assistant Examiner*—Leonard Smith
*Attorney, Agent, or Firm*—Haseltine, Lake & Waters

[57] ABSTRACT

A screw pump includes a screw unit having a drive screw and two impeller screws arranged symmetrically around the drive screw. The screws are enclosed in a housing having mutually intersecting passages for accommodating the screws, and the unit is constructed so that the screws seal against each other and against the housing to form chambers in which liquid is carried from the suction side to the pressure side during rotation of the screws. On the pressure side in the passage accommodating one of the impeller screws there is formed a recess which extends from the pressure side and the length of which is such that each chamber is opened at separate time intervals with respect to the two impeller screws instead of simultaneously.

2 Claims, 2 Drawing Figures

SCREW PUMP

The present invention relates to a screw pump having a driving screw and impeller screws in meshing engagement therewith.

Such screw pumps are normally symetrically constructed, so that the impeller screws are uniformly distributed around the periphery of the drive screw. In the case of a pump provided with three screws, which is the most normal construction, the impeller screws are arranged diametrically opposite each other on respective sides of the drive screw. In this way, the drive screw is relieved of radially acting forces.

A screw pump of this type is a displacement machine in which liquid is advanced by the axial displacement of closed chambers formed by the flutes of the screws. Theoretically, the liquid is advanced continuously without variations in pressure. In practice, however, such an ideal condition cannot be achieved, since the number of closed chambers is not constant during rotation of the screws. For example, the number of closed chambers can alternate between three and four at a specific given length of the screws and a given pitch thereof. This causes leakage losses to vary, and hence the output flow of the pump also varies, which in turn results in a pulsating flow, which can be disturbing, particularly when it is desired that the pump shall operate relatively silently. Theoretically, it is possible to maintain a constant number of closed chambers, by suitable selection of the lengths of the screws and of the housing surrounding said screws. This cannot be achieved in practice, however, owing to the required manufacturing tolerances. The pulsating flow remains, although to a lesser degree.

Since the extent to which sealing is obtained depends upon the position of rotation of the screws, in the case of a screw pump having two impeller screws placed symetrically on respective sides of the drive screw, the screws being provided with two threads, the maximum and minimum degree of sealing of the two impeller screws are co-incidental with one another. Pulsation is thus amplified, so that distinct pressure peaks and pressure throughs are obtained.

An object of the invention is to provide a screw pump in which the output flow is smoother than with the known pumps.

This is achieved in accordance with the invention by providing at the pressure side of the pump a recess in one wall of the impeller screw passage, the axial length of this recess being 0.25 $S_1$, where $S_1$ is the pitch of the thread of the drive screw.

The result of this arrangement is that each chamber defined by the threads and the casing is opened at separate points of time at the two impeller screws instead of simultaneously. When the screws have two threads, such as is normally the case, there are normally obtained two opening moments and therewith two pressure peaks per revolution. With the arrangement proposed in accordance with the invention, there is obtained instead four opening moments and therewith four pressure peaks per revolution, whereby pulsation is reduced.

The invention will now be more clearly described with reference to an embodiment thereof.

Figure 1:
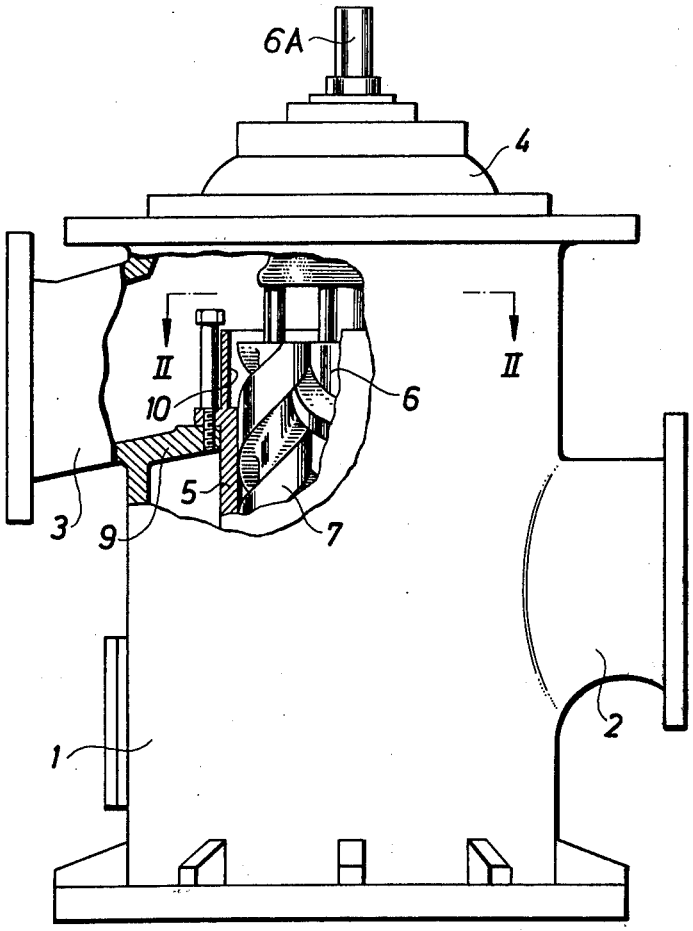
FIG. 1 is a side view, partly in section of a screw pump.

The illustrated screw pump comprises an outer pump housing 1 having an inlet 2 and an outlet 3 and is provided with an end wall 4. A screw unit comprising a casing 5, a drive screw 6 and two impeller screws 7, 8 are mounted in an opening in an intermediate wall 9 which divides the interior of the housing 1 into two chambers in a manner such that the suction side of the screw unit is in communication with the inlet 2 and its pressure side with the outlet 3. The drive screw 6 is connected with a shaft 6a which extends through the end wall 4 and which is intended to be connected to a drive motor.

Figure 2:
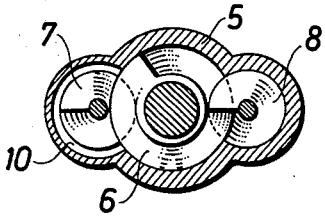
FIG. 2 is an end view of the actual screw arrangement taken through the line II — II in FIG. 1.

The housing 5 and the screws 6, 7, 8 are designed in a known manner such that the threads of the screws seal against each other and against the inner wall of the casing 5 to form chambers which, during rotation of the screws, migrate axially along the screw unit, each chamber first being closed against the pressure side and opened against the suction side, so that liquid is drawn thereinto, whereafter they are closed against the suction side and opened against the pressure side, whereupon liquid is expelled from the chambers. For this purpose, as will clearly be seen from FIG. 2, the casing 5 is provided with three mutually intersecting cylindrical passages each of which accomodates its respective screw and which passages are arranged with their longitudinal axes in the same plane so that the two impeller screws are placed diametrically opposite each other on their respective sides of the drive screw. In this way the drive screw is relieved of radial forces. In the illustrated embodiment the screws are provided each with two threads, which is normal in practice with respect to the illustrated design.

According to the invention, there is arranged in the passage of one impeller screw 7 at the pressure side of the screw unit a recess 10 whose axial length is 0.25 $S_1$. Sealing between the threads of the impeller screw and the wall of the casing is thus broken at this point, which means that each chamber is opened at an earlier point of time in this passage than in the passage of the impeller screw 8. More specifically, the chamber in the passage of the impeller screw 7 is opened at points of time lying centrally between the points of time during each revolution when opening takes place in the passage of the impeller screw 8, thereby to obtain four pressure peaks instead of two for each revolution of the screw, as hereinbefore described. In this way pulsations in flow are equalized.

As will readily be perceived the length of the screw unit must be so selected that at least a complete seal must constantly exist between the suction side and the pressure side at each position of the screw unit despite the fact that sealing has been broken in the region of the outlet 10.

I claim:

1. A screw pump comprising a screw unit having a drive screw and two impeller screws arranged symmetrically around the drive screw, said screws being enclosed in a housing having mutually intersecting passages for accommodating the screws, said unit being so constructed that the screws seal against each other and against the housing to form chambers in which, during rotation of the screws, liquid is carried from the suction side to the pressure side, characterized in that arranged on the pressure side in the passage accommodating one of the impeller screws is a recess which passes from the pressure side and the length of which is such that each chamber is opened at considerable differences in time in the passages of the two impeller screws.

2. A screw pump according to claim 1, characterized in that the length of the recess is 0.25 $S_1$, where $S_1$ is the pitch of the thread of the drive screw.

* * * * *